United States Patent [19]

Focke et al.

[11] 4,149,666

[45] Apr. 17, 1979

[54] PACKET, ESPECIALLY TO CONTAIN CIGARETTES

[75] Inventors: Heinz Focke; Jurgen Focke, both of Verden, Fed. Rep. of Germany

[73] Assignee: Focke & Pfuhl, Verden, Fed. Rep. of Germany

[21] Appl. No.: 809,818

[22] Filed: Jun. 24, 1977

[30] Foreign Application Priority Data

Jun. 24, 1976 [DE] Fed. Rep. of Germany ..... 2628433

[51] Int. Cl.[2] ..... B65D 13/00

[52] U.S. Cl. ..... 229/23 R; 229/19; 229/87 C; 229/1.5 R

[58] Field of Search ..... 229/19, 23 A, 23 R, 229/23 AB, 87 C, 1.5 R

[56] References Cited

U.S. PATENT DOCUMENTS

| | | | |
|---|---|---|---|
| 1,755,579 | 4/1930 | Grupe | 229/19 |
| 1,862,829 | 6/1932 | Roempler | 229/19 |
| 1,895,778 | 1/1933 | Andrews | 229/23 R |
| 2,488,194 | 11/1949 | Hunsworth | 229/23 R |
| 3,184,140 | 5/1965 | Peterson | 229/23 R |
| 3,666,164 | 5/1972 | Nederveld | 229/23 A |

FOREIGN PATENT DOCUMENTS

| | | | |
|---|---|---|---|
| 1074385 | 1/1960 | Fed. Rep. of Germany | 229/23 AB |

*Primary Examiner*—William Price
*Assistant Examiner*—Joseph M. Moy
*Attorney, Agent, or Firm*—Sughrue, Rothwell, Mion, Zinn and Macpeak

[57] ABSTRACT

A package of the shell and slide type for accommodation of cigarettes is disclosed. This type of package has an outer shell and an inner sliding drawer, with the drawer having a center section with two upwardly folded bridges attached on opposite sides to the center section and cover flaps attached on the two orthogonal opposite sides. The sliding drawer itself is composed from two partial blanks, one of which has the bridge elements and the other the cover flaps. The blanks are cut from a single web without any waste material.

2 Claims, 5 Drawing Figures

PACKET, ESPECIALLY TO CONTAIN CIGARETTES

The invention relates to a packet, especially to contain cigarettes, consisting of one or more cut-out shapes which are of such configuration that they cannot be produced without waste by cutting from a web or the like.

In the configuration of cut-out shapes for the production of packets, value must be attached to shaping the cut-out shapes if possible so that they can be cut without waste from webs or the like of the packet material. Frequently however the necessary configuration of a cut-out shape does not permit a waste-free production thereof by cutting from a web. This is valid especially if any laterally protruding tabs or the like are necessary which extend only over part of the length of the cut-out shape. Furthermore waste is unavoidable if the cut-out shapes should possess rounded "corners".

The invention is based upon the problem of shaping packets so that cut-out shapes can be produced without waste even if by reason of their outline configuration they do not originally permit waste-free production by cutting from webs or the like.

To solve this problem the packet according to the invention is characterised in that the cut-out shape is assembled from several component cut-out shapes each of which can be produced without waste.

Accordingly the fundamental idea of the invention consists in dividing a cut-out shape of the above-described configuration so that the component cut-out shapes then obtained each independently have a matching form and thus can be cut in waste-free sequence from a web. Then these component cut-out shapes are assembled to form the total cut-out shape with the requisite configuration, with slight overlapping and sticking or welding in the overlap region.

The invention can be used especially advantageously in the production of a drawer for a packet consisting of outer sleeve and drawer. The cut-out shape of the drawer, shaped with rounded "corners" and lateral tabs for the formation of upright flanges, is produced in two individual cut-out shapes each separately. The one component cut-out shape is here formed so that the lateral tabs of the one component cut-out shape adjoin the following component cut-out shape in fitting manner. The other component cut-out shape of the drawer consists here only approximately of one half of the cut-out shape for the drawer with rounded "corners" on the one side and matching, pointedly terminating lappets on the other side. The component cut-out shapes are consequently cut from webs of different widths and subsequently connected with one another by adhesion with overlap.

Figure 1:
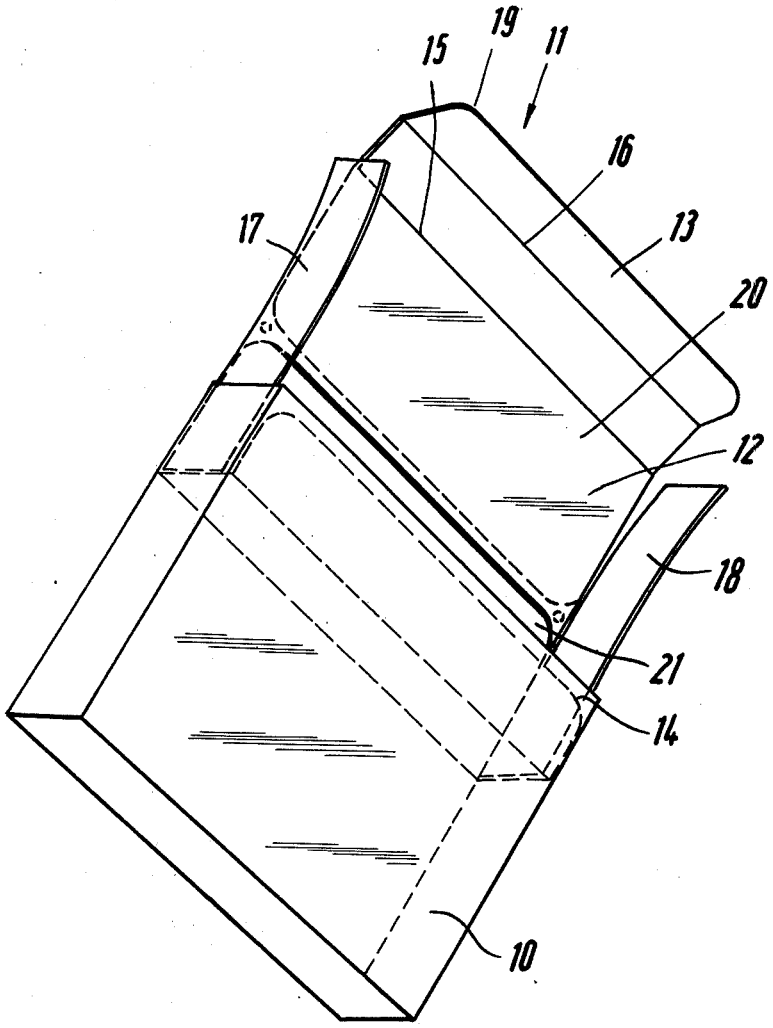
Figure 2:
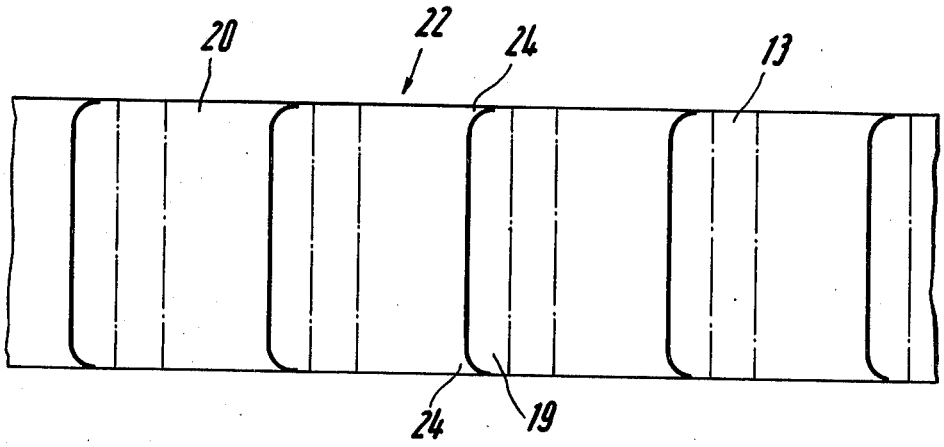
Figure 3:
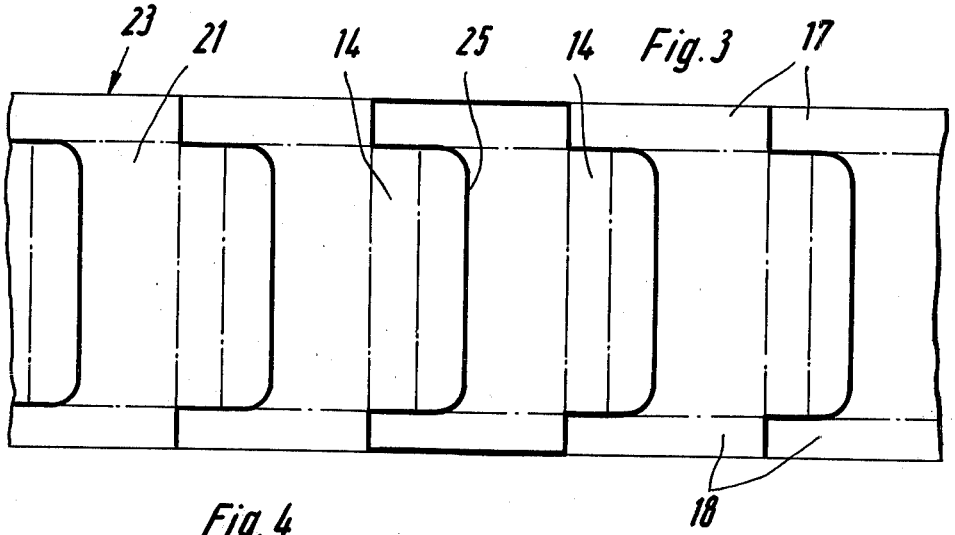
Figure 4:
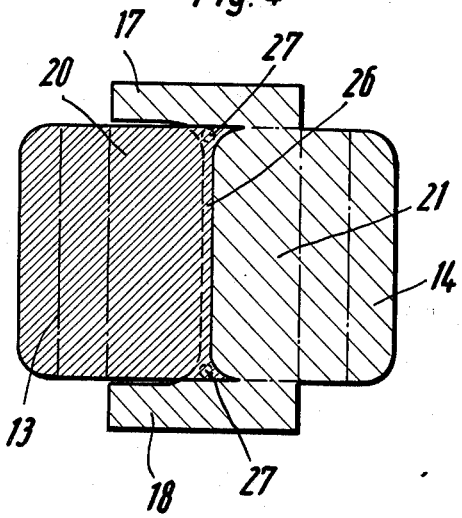
Figure 5:
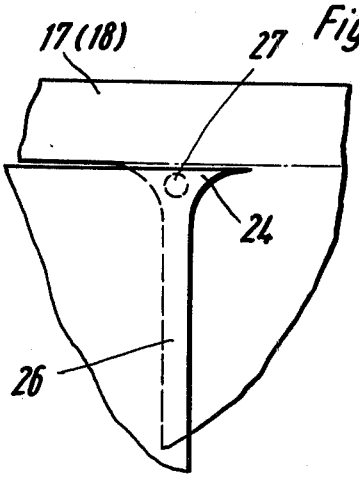

An example of embodiment of the invention will be explained in greater detail hereinafter with reference to the drawings, wherein:

FIG. 1 shows a packet with sleeve and drawer as preferred field of use of the invention, in perspective representation, FIG. 2 shows a detail of a web of packet material for the production of a first component cut-out shape, FIG. 3 shows a web for the production of a second component cut-out shape, FIG. 4 shows the spread-out cut-out shape for the formation of the drawer of the packet according to FIG. 1 on a reduced scale, FIG. 5 shows a detail of the cut-out shape according to FIG. 4 on an enlarged scale.

The packet as shown in the opened position in FIG. 1 serves primarily to contain cigarettes (not shown). The packet consists of two parts, namely an outer parallelepipedic sleeve 10 and a drawer 11 which can be introduced into the latter. The drawer consists of a middle part 12 the dimensions of which correspond substantially to the length and height of the sleeve 10. The middle part 12, when the packet is in the closed position, lies approximately in coincidence against an adjacent wall of the sleeve 10. In the region of the open bottom and lid sides of the sleeve 10 a lid flap 13 and a bottom flap 14 adjoin the middle part 12 of the drawer 11. The flaps 13 and 14 are separated from the middle part 12 and additionally divided by fold lines 15 and 16. With the aid of these fold lines the flaps 13 and 14 can be folded in each case into U-shape in relation to the middle part 12 and thus form the bottom and lid of the packet.

In the present case the middle part is provided over its whole length with lateral upright flanges 17 and 18 which rest on the narrow side walls of the sleeve 10. The cut-out shape for the formation of the drawer 11 of this configuration and its lid and bottom flaps 13 and 14 is formed with rounded corners 19.

Due to the described formation of the drawer 11, especially due to the laterally arranged flanges 17 and 18 which do not extend over the whole length of the drawer 11, it is not possible to obtain the cut-out shape for the formation of the drawer 11 as a unit without waste by cutting from a web or the like. For this reason the drawer 11 is here divided into two component cut-out shapes 20 and 21. Each of the component cut-out shapes 20 and 21 is obtained from a separate web 22 and 23 respectively of the packet material.

As shown in FIG. 2, the component cut-out shape 20 obtained from the web 22 is formed without lateral flanges 17 and 18, and accordingly consists only of about half of the middle part 12 and the adjoining lid flap 13. The component cut-out shape 20 of such formation can be cut from the web 22 without waste by punching or the like, namely with formation of the rounded corners 19. The adjoining cut-out shape in each case thus forms analogously shaped, pointedly terminating lappets 24 on the side opposite to the "corners" 19.

Referring to FIG. 5, the component cut-out shape 21 is cut with the lateral flanges 17 and 18 from a correspondingly wider web 23. The component cut-out shape 21 is here of such shape and dimensions that the zone for the formation of the bottom flap 14 is capable of entering in fitting manner into a recess 25 laterally defined by the flanges 17 and 18. Thus this component cut-out shape likewise can be produced without waste.

The two component cut-out shapes 20 and 21 are assembled into the overall cut-out shape, visible especially from FIG. 4, for the formation of the drawer 11. This assembly proceeds here in a manner in which the mutually facing transverse edges of the component cut-out shapes 20 and 21, extending approximately in the middle region of the middle part 12, are arranged with a narrow overlap 26. This overlap 26 is widened in the edge region by the lappets 24 and by analogous curvatures of the component cut-out shape 21. In the region of the overlap 26, namely especially in the region of the said widening, that is at the lappets 24, the component cut-out shapes 20 and 21 are connected with one another in the present case by glue spots 27. The arrangement is made such here that the component cut-out shape 20 forming the lid flap 13 rests on the component cut-out shape 21 in the region of the overlap 26. Thus on pushing of the drawer 11 into the sleeve 10, no protruding edge can come to abut on the edge of the sleeve 10. The glue spots 27 are sufficient to produce the adequately durable connection.

One particular feature arising from the present design consists in that the upright flanges 17 and 18 are not connected with the zone of the drawer 11 corresponding to the component cut-out shape 20.

We claim:

1. A package of the shell and slide type comprising:

an outer shell; and an inner sliding drawer, said inner sliding drawer comprising first and second blanks, each of said blanks being cut from a separate web of a corresponding width of packaging material, said first and second blanks each having two fold lines so as to be foldable into first, second and third panels, said second panel of each of said blanks being between said first and second panel, said first panel of each of said blanks having corners cut to mate with the corners of said third panel to form a continuous web so that each of said blanks may be cut without waste, said second blank having lateral rectangular tabs on opposite sides of said third panel of said second blank, said tabs extending lengthwise beyond the edge of said third panel, of said second blank, said third panel of said first blank being positioned substantially between the extended portions of said tabs and slightly overlapping said third panel of said second blank, said blanks being adhered to one another along at least a portion of the overlapping portion.

2. A package according to claim 1 characterized in that said blanks are adhered at adhesion spots at the overlapping corners.

* * * * *